US005239709A

United States Patent [19]

Masotti

[11] Patent Number: 5,239,709

[45] Date of Patent: Aug. 31, 1993

[54] POOL CLIP

[76] Inventor: John Masotti, 2575 Dundas Street West, Unit 20, Mississauga, Ontario, Canada, L5K 2M6

[21] Appl. No.: 676,518

[22] Filed: Mar. 28, 1991

[51] Int. Cl.[5] ..... E04H 4/14

[52] U.S. Cl. ..... 4/503; 4/506

[58] Field of Search ..... 4/498, 503, 504, 506

[56] References Cited

U.S. PATENT DOCUMENTS

| | | | |
|---|---|---|---|
| 4,107,826 | 8/1978 | Tysdal | 4/498 X |
| 4,158,244 | 6/1979 | Stefan | 4/503 X |
| 4,601,073 | 6/1986 | Methot | 4/506 |
| 4,713,849 | 12/1987 | Kindness | 4/506 X |
| 4,967,424 | 11/1990 | Stegmeier | 4/506 X |
| 4,974,266 | 12/1990 | Vultaggio et al. | 4/506 |
| 4,980,934 | 1/1991 | Dahowski et al. | 4/506 X |
| 5,065,461 | 11/1991 | Shehan et al. | 4/503 |

FOREIGN PATENT DOCUMENTS

| | | | |
|---|---|---|---|
| 2214799 | 9/1989 | United Kingdom | 4/503 |

*Primary Examiner*—Henry J. Recla
*Assistant Examiner*—Robert M. Fetsuga
*Attorney, Agent, or Firm*—Eugene J. A. Gierczak

[57] ABSTRACT

A break away clip releasably engageable with a wall depending from a swimming pool coping where the wall has a raised rib, and an edge of a pool cover where the edge has a retaining groove, the clip presenting in cross-section a pair of spaced apart legs adapted to releasably embrace the depending wall, the legs are connected at one end and one of the legs includes a retaining groove between the legs which is adapted to receive the rib presented by the depending wall of the swimming pool coping, the clip including a channel presenting a lip releasably engageable with the retaining groove of the edge of the pool cover.

1 Claim, 1 Drawing Sheet

POOL CLIP

FIELD OF INVENTION

This invention relates to break away clip engagable with a swimming pool coping and in particular relates to the break away cover clip which is releasably securable with a projecting edge of a swimming pool coping.

BACKGROUND OF THE INVENTION

Residential and public pools are a common sight in the North American market place.

Moreover, pools may be excavated in the backyard of residential homes and can be constructed from concrete or plastic liners in a fashion well known to those persons skilled in the art.

Such pools normally include a coping which is generally the top layer of the swimming pool wall which may or may not be sloped to carry off water. Such coping may be constructed of materials which include, concrete, ceramic tiles, or aluminum extruded parts.

The coping in plastic lined swimming pools is generally constructed of extruded aluminum and usually includes a groove having an upstanding wall which is adapted to engage and retain the top edge of the plastic liner.

The coping may also include a second groove which in the past has been used to retain the edge of a swimming pool cover which is used to cover a swimming pool when not in use. Such swimming pool covers are used to prevent debris from falling into the swimming pool.

In winter climates snow and ice can accumulate on the top of the swimming pool cover which can cause the swimming pool cover to rip once the load exceeds a predetermined level. Furthermore, such swimming pool covers may also rip in the event that a large quantity of rain water accumulates at the top thereof or any other heavy object which may be accidentally placed thereon.

It is an object of this invention to provide an improved swimming pool break away cover clip which is more efficient than that which has been presently used. In particular, it is an object of this invention to provide a swimming pool cover clip which will minimize the possibility of damage to a swimming pool cover.

It is the broadest aspect of this invention to provide a break away clip engagable with a swimming pool coping.

It is another object of this invention to provide a break away cover clip releasably securable with a projecting edge of a swimming pool coping and a pool cover, said clip extending generally longitudinally along the length thereof and presenting in cross-section, a pair of spaced apart legs adapted to releasably embrace said projecting edge of said swimming pool coping, and a channel for receiving an edge of said pool cover.

It is another aspect of this invention to provide a combination of a break away cover clip and a swimming pool coping comprising: a swimming pool coping extending longitudinally along the length thereof and presenting in cross-section a groove, said groove including an edge depending vertically downwardly; a break away cover clip extending longitudinally along the length thereof and presenting in cross-section a pair of spaced apart walls joined together by a connecting wall defining a downwardly opening channel, a leg connected to one of said walls in the region remote from said connecting wall, said leg spaced apart from said one of said walls and adapted to embrace said edge between said leg and said one of said wall; and a pool cover presenting an edge receivable by said channel, whereby said cover clip breaks away from said edge when said cover experiences a pre-selected load so as to prevent damage to said cover.

DRAWINGS TO THE INVENTION

These and other objects and features shall now be described in relation to the following drawings.

DESCRIPTION OF INVENTION

Like parts have been given like numbers throughout the Figures.

Figure 1:
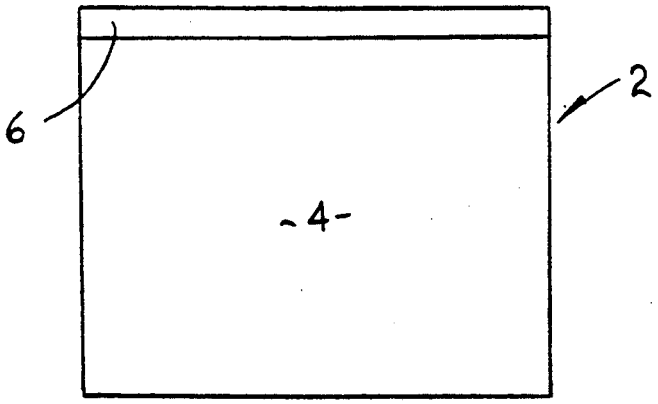
FIG. 1 is a partial elevational view of a swimming pool illustrating the coping.
Figure 2:
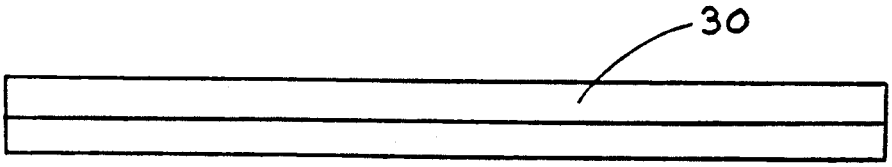
FIG. 2 is front elevational view of said break away cover clip.

FIG. 1 generally illustrates a partial front elevational view of a swimming pool 2 showing the vertical wall 4 and coping 6.

The vertical wall 4 of the swimming pool 2 may be comprised of any number of well-known materials such as concrete, plastic or the like.

The coping 6 may also be comprised of any number of well-known materials, although aluminum extruded coping is commonly used at the present time. As best illustrated in FIG. 1 the coping 6 generally comprises the top edge of the perimeter of a swimming pool.

Figure 3:
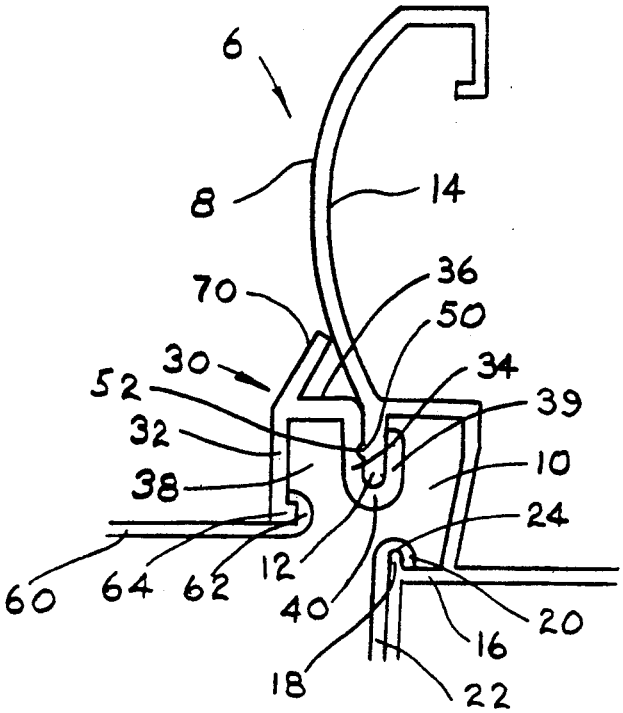
FIG. 3 is a side elevational view of said break away cover clip engagable with said coping and said cover.

FIG. 3 illustrates the cross section of the coping 6 and shows the front face 8, the groove 10 and edge or wall 12 which projects or depends in the vicinity of recess or channel 10.

The back wall 14 of coping 6 would be flush against the concrete of a pool in a manner well known to those persons skilled in the art such that front face 8 may be easily seen by a person inside of the pool 2.

FIG. 3 shows a vertical cross section view through the coping 6 and illustrates that recess 10 also includes a bottom wall 16 with an upstanding projecting lip 18 which is adapted to be received by the edge 20 of a swimming pool liner 22. The edge 20 of swimming pool liner 22 includes a liner groove or channel 24 which hangs on lip 18.

The coping 6 also includes a projecting edge or wall 12 which is adapted to be received by the break away clip 30.

The clip 30 has a cross section as illustrated in FIG. 3.

The clip 30 may be comprised of any number of well-known materials such as plastic or the like to provide the resiliency of the parts to be described herein.

The break away clip 30 includes a pair of generally spaced apart walls 32 and 34 which are joined together by a connecting wall 36 so as to define a channel 38 which opens vertically downwardly as shown in FIG. 3.

The break away clip 30 also presents a pair of spaced apart legs 34 and 39 which are joined together along one end 40 thereof. It will be seen from FIG. 3 that one of the walls 34 defines one of the legs 34 which legs are connected together in the region remote from the connecting wall 36. In other words, the break away clip 30 defines generally an S-shaped cross section as shown in FIG. 3.

One of the legs 34 includes a retaining groove means 50 which is adapted to receive a raised bump or rib 52 presented by the projecting wall 12. The projecting edge 12 in the embodiment illustrated in FIG. 3 comprises a rib which runs along the longitudinal length of the coping.

Accordingly the break away clip can be snapped into place as illustrated in FIG. 3 whereby the resilient nature of the plastic legs 34 and 36 embrace the sides of the projecting edge 12 and a releasably retained therein by the action of the retaining groove 50 and the rib 52.

A swimming pool cover 60 includes an edge 62 which presents a pool cover retaining groove which is adapted to be releasably retained by the channel 38 and particularly to engage with channel lip 64.

The break away clip 30 also includes an arm 70.

Accordingly when it is desired to use a pool cover 60 the break away clip may be fastened to the edge 62 of pool cover 60 by sliding the edge 62 within the channel 38 of the break away clip 30. Thereafter the break away clip 30 may be snapped into place by pushing the legs 34 and 39 over the projecting wall 12.

If snow or ice accumulates on the top of the cover 60 beyond a pre-determined limit then the break away clip 30 will break away from coping 6 thereby preventing the pool cover from tearing as has been experienced in the past.

Although this invention discloses the use of a coping 6 having one groove 10 the invention herein may be utilized by having copings having a number of grooves proved that one of the grooves includes a projecting edge 12 as illustrated herein.

Although the preferred embodiment, as well as the operation having been specifically described in relation to the drawings, it should be understood that variations of the preferred embodiment could easily be anticipated and achieved by a skilled man in the trade without departing from the spirit of this invention. Accordingly this invention should not be understood to be limited to the exact form revealed in the drawings.

The embodiments of the invention in which an exclusive property or privilege is claimed are defined as follows:

1. The combination of a break away cover clip comprising:

(a) a swimming pool coping presenting in cross-section a groove for receiving a pool liner, said groove including a wall depending vertically downwardly;

(b) a break away cover clip presenting in cross-section:

(i) first and second spaced apart walls joined together by a connecting wall defining a downwardly opening channel when said clip is secured to said coping, said first spaced apart wall presenting a lip;

(ii) a leg connected to said second spaced apart wall opposite said connecting wall, said leg spaced apart from said second spaced apart wall and adapted to releasably receive said depending wall between said leg and said second spaced apart wall; and (c) a pool cover presenting an edge with a retaining groove for receiving said lip presented by said first spaced apart wall;

whereby said cover and said leg and said second spaced apart wall breaks away from said depending wall when said swimming pool cover experiences a pre-selected load so as to prevent damage to said cover.

* * * * *